US005172771A

United States Patent [19]

Wilson

[11] Patent Number: 5,172,771

[45] Date of Patent: Dec. 22, 1992

[54] REVERSIBLE IMPACT-OPERATED BORING TOOL

[75] Inventor: Dirk A. Wilson, Stillwater, Okla.

[73] Assignee: Charles Machine Works, Inc., Perry, Okla.

[21] Appl. No.: 609,897

[22] Filed: Nov. 6, 1990

[51] Int. Cl.[5] ..... E21B 4/14

[52] U.S. Cl. ..... 173/1; 173/91; 173/212; 91/234

[58] Field of Search ..... 173/1, 91, 137, 139; 91/234; 175/19

[56] References Cited

U.S. PATENT DOCUMENTS

| | | | |
|---|---|---|---|
| 3,407,884 | 10/1968 | Zygmunt et al. | 173/91 |
| 3,727,701 | 4/1973 | Sudnishnikov et al. | 173/91 |
| 3,744,576 | 7/1973 | Sudnishnikov et al. | 173/91 |
| 3,756,328 | 9/1973 | Sudnishnikov et al. | 173/91 |
| 3,865,200 | 2/1975 | Schmidt | 175/19 |
| 4,078,619 | 3/1978 | Sudnishnikov et al. | 175/19 |
| 4,214,638 | 7/1980 | Sudnishnikov et al. | 173/1 |
| 4,221,157 | 9/1980 | Schmidt | 91/416 |
| 4,250,972 | 2/1981 | Schmidt | 173/91 |
| 4,295,533 | 10/1981 | Schmidt | 175/19 |
| 4,537,265 | 8/1985 | Cox et al. | 175/19 |
| 4,609,052 | 9/1986 | Lewin | 173/91 |
| 4,618,007 | 10/1986 | Kayes | 175/19 |
| 4,629,008 | 12/1986 | Kostylev et al. | 173/91 |
| 4,637,476 | 1/1987 | Gurkov et al. | 173/136 |
| 4,662,457 | 5/1987 | Bouplon | 173/91 |
| 4,683,960 | 8/1987 | Kostylev et al. | 173/91 |
| 4,697,647 | 10/1987 | Kostylev et al. | 173/91 |
| 4,708,211 | 11/1987 | Shemyakin et al. | 175/19 |
| 4,733,731 | 3/1988 | Tkach et al. | 173/91 |
| 4,819,741 | 4/1989 | Terskov et al. | 173/91 |
| 4,840,237 | 6/1989 | Roemer | 175/19 |
| 4,913,243 | 4/1990 | Jenne et al. | 175/57 |
| 4,953,626 | 9/1990 | Püttmann et al. | 173/91 |
| 5,050,686 | 9/1991 | Jenne . | |
| 5,056,608 | 10/1991 | Hemmings . | |

FOREIGN PATENT DOCUMENTS

| | | | |
|---|---|---|---|
| 956928 | 10/1974 | Canada | 255/13 |
| 0325393 | 1/1989 | European Pat. Off. . | |
| 2800050 | 2/1978 | Fed. Rep. of Germany . | |
| 2022169 | 3/1979 | United Kingdom . | |
| 2111565 | 12/1982 | United Kingdom . | |
| 2173234 | 12/1984 | United Kingdom . | |
| 2227039 | 11/1989 | United Kingdom . | |

*Primary Examiner*—Douglas D. Watts
*Assistant Examiner*—Scott A. Smith
*Attorney, Agent, or Firm*—Richards, Medlock & Andrews

[57] ABSTRACT

A reversible impact-operated boring tool and a method for reversing the direction of operation of the same rapidly and safely is disclosed. The tool according to the invention possesses a second supply line for supplying pressurized fluid to the tool. The second supply line provides pressurized fluid to a directional valve within the tool. The tool operates in the forward mode for borrowing into the soil when pressurized fluid is supplied to this directional valve. When the pressurized fluid supply is terminated and the fluid is exhausted from the valve, the tool operates in the reverse mode. The tool according to the invention can be reversed safely without any need for hose manipulation and without turning off the primary fluid supply line.

3 Claims, 2 Drawing Sheets

REVERSIBLE IMPACT-OPERATED BORING TOOL

FIELD OF THE INVENTION

The present invention relates to the field of underground boring, and particularly to horizontal boring for placement of utility lines and the like.

BACKGROUND OF THE INVENTION

Impact-operated boring tools are well-known in the art. U.S. Pat. No. 3,756,328 issued to Sudnishnikov et al. discloses one such device. Impact-operated boring tools are used for burrowing holes in soil, particularly horizontal or near horizontal passages for installation of utility lines when trenching is undesirable. As the name implies, such boring tools function by impact. The tools possess a striking member (striker) slidable within a cylindrical housing. The striker delivers impacts on a surface at the front end of the housing. This impacting motion within the tool itself causes the soil around the tool to compact away from the nose of the housing, thus forming a hole.

The movement of the striker against the front surface is accomplished through the supply of pressurized fluid (such as compressed air) to a chamber behind the striker. Reciprocal movement is accomplished through the use of a control sleeve and ports in the striker. When the striker reaches a particular point in its forward path, the ports move past the sleeve to define an opening between the chamber behind the striker and the chamber in front of the striker. This allows the compressed air to pass to the chamber along the sides and in front of the striker. Because the cross-sectional area of the chamber in front of the striker is larger than the chamber behind the striker, the compressed air in the front chamber then forces the striker backwards. As the striker moves backwards, the opening defined by the ports is closed. When the striker reaches a particular point in its rearward path, the ports in the striker again move past the control sleeve to define an opening between the front chamber and exhaust passages leading to the atmosphere. The compressed air from the front of the striker is thus exhausted to the atmosphere. At this point, the pressure inside the chamber behind the striker again becomes greater than the pressure in front of the striker. Consequently, the striker begins to move forward once more.

Reversible impact-operated boring tools are also well-known in the art. U.S. Pat. No. 4,683,960 issued to Kostylev et al. discloses such a device. A reversing mechanism is often necessary to retrieve the tool from the hole being burrowed in case the tool encounters an obstruction in the soil or deviates greatly from a straight path.

Over the years, numerous attempts have been made to improve the safety and reliability of the reversing mechanisms. Trying to simplify the means for switching from the forward to the reverse mode of operation often resulted in uncertainty about which direction the machine was traveling in the hole. It seemed that the simpler it was to switch modes, the easier it was to switch accidently. Apart from the obvious danger this posed to the operators of the tool, this could also be very time consuming. If an operator were to switch modes accidently, time thought to be spent on burrowing may actually be time spent on retrieving the tool unwittingly. The error would not be discovered immediately, thereby wasting valuable operation time.

The prior art discloses various means for accomplishing reverse motion. Some require interrupting the pressurized fluid supply. Others require manipulation of the hose supplying the pressurized fluid to the tool, either by rotating the hose or by pulling it back. Still others require both the interruption of the pressurized fluid supply and the manipulation of the hose. However, each means has its disadvantages.

U.S. Pat. No. 4,662,457 to Edward J. Bouplon discloses a reversing mechanism requiring both means. The pressurized fluid supply must be terminated and then the hose must be rotated approximately one quarter turn clockwise in order to switch to the reverse mode of operation. Sometimes, when the pressurized fluid supply is terminated and the tool is therefore shut off, the tool does not restart when the pressurized fluid supply is recommenced. U.S. Pat. No. 4,840,237 to Helmuth Roemer discloses a reverse mechanism requiring that the hose be rotated. When the hose is flexible, it is often difficult to relate the degree of rotational motion of the hose at the surface to the degree of rotational motion at the tool itself, which may be some distance away. Consequently, it is often difficult to reverse the operation of the tool, or to be certain of the direction of operation.

U.S. Pat. No. 4,683,960 to Kostylev et al. discloses a reversing mechanism that requires applying sufficient force to a steel cable surrounding the air supply hose to overcome the compression force of a spring within the cable. Compression of the spring enables reverse operation of the tool. An alternate embodiment of the invention depicts a flanged tube within the air supply hose for accomplishing the same result as the steel cable—compression of the spring. There is no way of knowing whether the tension force is sufficient to overcome the compression force of the spring, which may be some distance away, in order to reverse the direction of operation. Consequently, the uncertainty concerning which direction the tool is operating remains.

U.S. Pat. No. 4,214,638 to Sudnishnikov et al. is an earlier patent which discloses a reversing mechanism that does not require manipulation of the fluid supply hose. The invention employs a control valve for alternately supplying compressed air or suction to the boring tool. When suction is applied, a control element within the tool is displaced. The tool operates in the reverse mode when compressed air is then resupplied. To switch back to the forward mode, suction is re-applied. This causes the control element to be displaced back to the position for forward movement. While no hose manipulation is required in the above invention, the exact same procedure is employed for switching from forward to reverse mode. Consequently, uncertainty regarding which direction the tool is operating remains.

U.S. Pat. No. 4,250,972 issued to Paul Schmidt on Feb. 17, 1981 discloses a patent employing a second compressed air supply. The patent claims to disclose a method for reversing operation of impact-operated boring tools that does not require any hose manipulation and which assures starting of the ram borer in any position along a borehole. Reverse motion is achieved when the second compressed air supply is initiated.

The impacting motion within the tool presents some problems associated with the service-life of the tool. Most tools contain a sleeve made of an elastomeric material within the tailpiece assembly to dampen some of the shocks emitted by the tool in operation. The sleeve is placed between the fluid inlet tubes and the tailpiece, and is usually glued to both. It is the gluing in this region which has presented the problems. The glue must be carefully chosen to be strong enough to withstand the shocking motion. However, the attachment becomes weakened as the glue ages and dirt gathers in the region of the gluing, thus the service-life of the tool is decreased.

Due to the uncertainty presented by the current means for reversing operation of impact-operated boring tools, and the increased labor and time often involved, an alternate means for reversing operation quickly and safely is needed. Due to the decrease in service-life associated with current shock dampening means in tailpiece assemblies, an alternate assembly is needed.

SUMMARY OF THE INVENTION

In one aspect, the invention relates to a reversible impact-operated boring tool. The tool disclosed employs a secondary fluid supply line which supplies pressurized fluid to a directional valve within the tool. When pressurized fluid is supplied to this directional valve, the tool operates in the forward mode to burrow holes in the soil. When pressurized fluid is exhausted from this directional valve, the tool operates in the reverse mode for retrieval. The primary pressurized fluid supply which enables reciprocal movement of the tool does not have to be terminated, nor does the supply hose have to be manipulated in any manner.

In another aspect, the invention relates to a distinct valving member comprising an inner spring and which is attached in such a manner permitting it to slide along both the outer and inner fluid inlet tubes while preventing the passage of pressurized fluid through the region of attachment. The sliding motion is accomplished using a secondary fluid supply by which pressurized fluid is supplied to the inner chamber of the directional valve. A spring surrounding the inner fluid inlet tube and contained within the directional valve helps to keep the directional valve in the position enabling forward motion of the tool. When the pressurized fluid is exhausted from the directional valve, the pressure exerted on the forward portion of the valve from the primary fluid supply is sufficient to compress the spring, thereby moving the directional valve to the position enabling the rearward motion of the tool.

In another aspect, the invention relates to a modification in the tailpiece assembly. The tailpiece assembly of the tool disclosed comprises a shock dampener glued to the exterior of the outer fluid inlet tube and to the interior of a steel canister. The steel canister is then press fit into the tailpiece. The press fitting of the canister eliminates some of the problems in service-life associated with gluing the shock dampener directly to the tailpiece such as aging and weakening of the glue, maintaining cleanliness of the assembly, and selection of inappropriate glue.

In another aspect, the invention relates to a method for rapidly alternating from the forward mode of operation to the reverse mode of operation, comprising a secondary fluid supply possessing a control valve. When the control valve is turned to a particular position, pressurized fluid is supplied to a directional valve, and the striker is directed against a surface in the front of the tool. This causes the tool to move forward. When the control valve is turned to another position, pressurized fluid is exhausted from the directional valve, and the impact of the striking member is now directed to a surface in the rear of the tool. This causes the tool to move rearward. The tool can be switched back to the forward mode by turning the control valve so that pressurized fluid is supplied to the directional valve once more.

BRIEF DESCRIPTION OF THE DRAWINGS

For a more complete understanding of the present invention, and the advantages thereof, reference is now made to the following description, taken in conjunction with the accompany drawings, in which.

DESCRIPTION OF THE PREFERRED EMBODIMENTS

Figure 1:
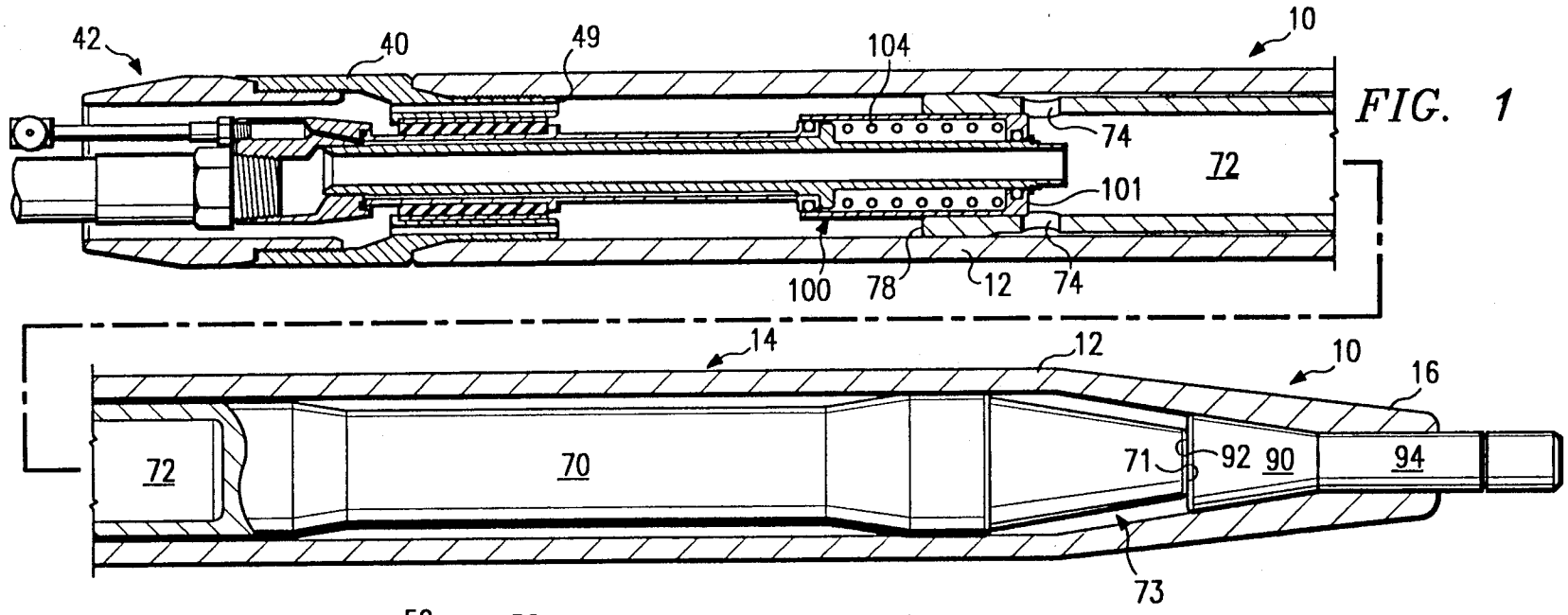
FIG. 1 is a longitudinal side view of the reversible impact-operated boring tool in the forward mode of operation.
Figure 2:
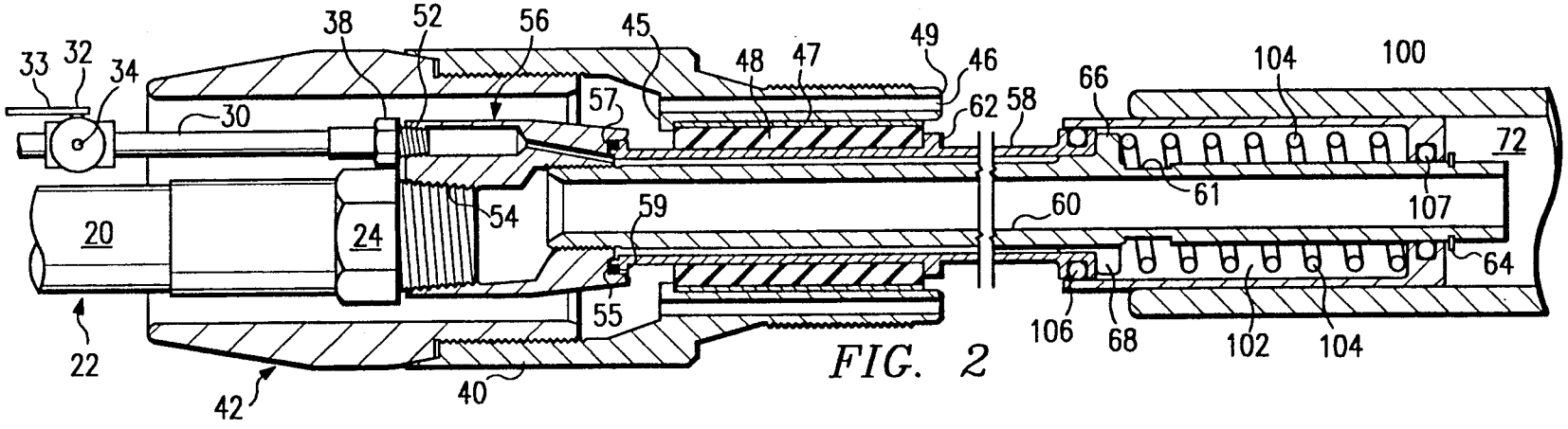
FIG. 2 is a longitudinal sectional view of the reversible impact-operated boring tool illustrating the reversing mechanism in greater detail.
Figure 3:
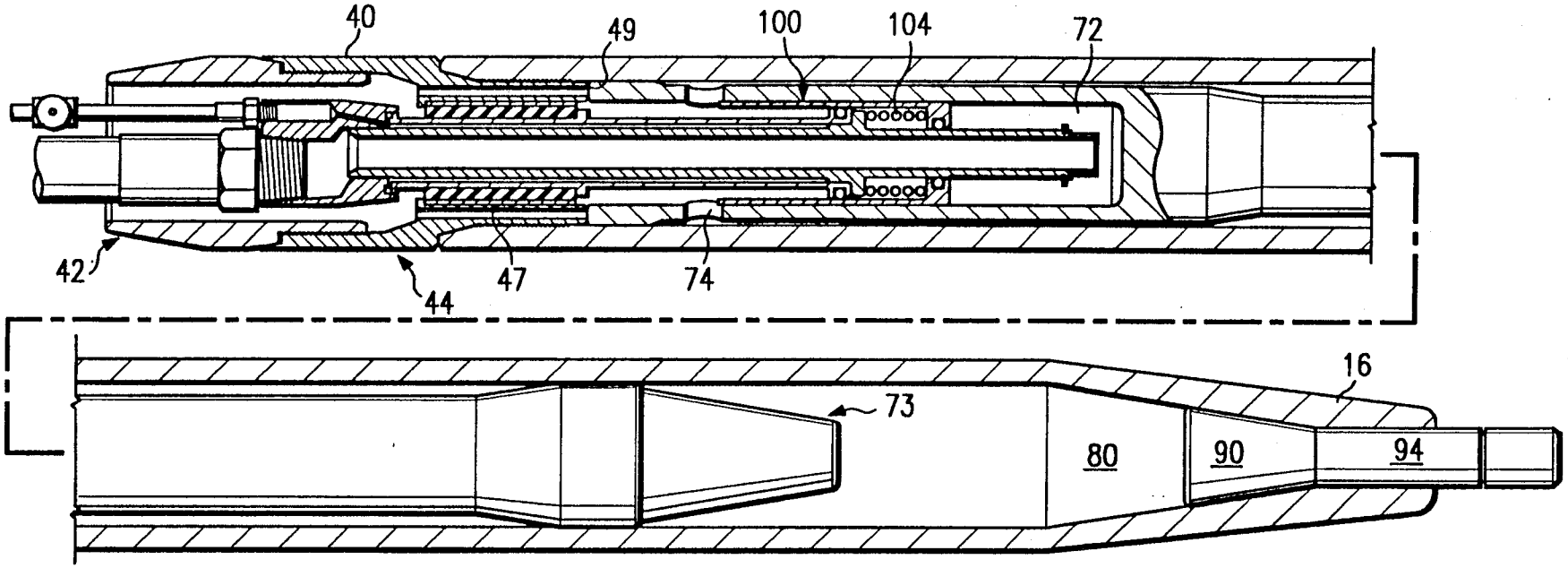
FIG. 3 is a longitudinal side view of the reversible impact-operated boring tool in the reverse mode of operation.
Figure 5:
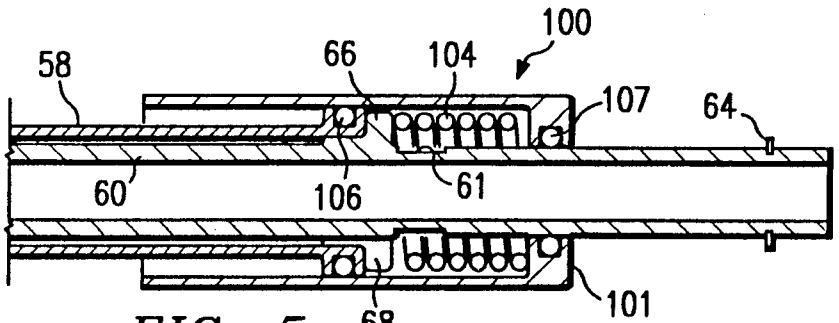
FIGS. 4 and 5 are sectional views depicting the directional valving member in the positions for forward (FIG. 4) and reverse operation (FIG. 5) of the tool.
Figure 4:
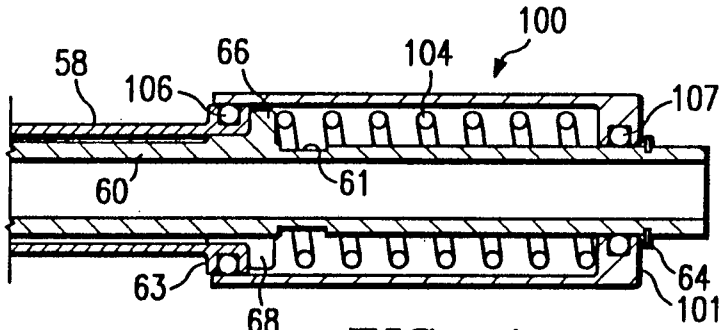

The FIGURES illustrate a reversible impact-operated boring tool 10 forming a first embodiment of the present invention which includes a hollow outer housing 14 that consists of a torpedo-shaped body 12 and a coaxial tailpiece 40. An air driven piston-like striker 70 reciprocates lengthwise in the housing 14. If the striker 70 impacts at the right end of the housing 14 as seen in FIG. 1, the tool will be driven forward. Conversely, if the striker impacts at the left end of the housing as seen in FIG. 3, reverse motion results.

To control the motion of striker 70, a directional valving member 100 is provided which is slidably mounted on inner fluid inlet tube 60 and outer fluid inlet tube 58. The valving member 100 is slidable between a first, forward position on the tubes, as seen in FIG. 1, and a second, rearward position as seen in FIG. 3. A valving member chamber 102 is defined inside the valve member 100. A spring 104 inside valving member chamber 102 is in contact with the forward end of the valving member 100 and with outer fluid inlet tube 58 adjacent the rear end of the valving member 100. A slotted spring supporting ferrule 68 circumferentially surrounds the inner fluid inlet tube and comprises three slots which communicate the valve member chamber with the fluid supply.

The striker 70 defines jointly with the housing 14 a rear operating chamber 72 and a forward operating chamber 80. The striker 70 is essentially cylindrical in shape but has a frustroconical taper at the front to form a flat forward impact surface 71. The striker has ports 74 through the cylindrical shell of the striker which connect the forward chamber 80 alternately with the rear chamber 72 and then with the exhaust passages 49 during reciprocal movement.

There is an anvil 90 fixedly attached to the outer housing 14 which is circumferentially surrounded by the outer housing 14 at the tapered end of the housing and which projects beyond the outer housing 14 at the front of the tool. The anvil 90 contains a rearwardly facing impact surface 92 upon which the striker 70 impacts during forward motion of the tool. The front end projection 94 accommodates different boring heads for different soil compositions.

Both fluid inlet tubes 60 and 58 are connected to hoses supplying pressurized fluid through a hose nut 56 in the rearward region covered by the tailpiece 40. The inner fluid inlet tube 60 is threadedly attached to the hose nut 56. The outer fluid inlet tube is attached to the hose nut 56 by means of a flange 59 on the outer fluid inlet tube 58 in operative association with an annular notch 55 in the hose nut which together accommodate an "O" ring 57 to provide an "O" ring seal when the inner fluid inlet tube 60 is screwed into the hose nut. A secondary fluid supply hose with a diameter of ⅛ inch is in operative association with the secondary fluid inlet tube through the smaller passage 52 in the hose nut 56 which is threaded at the rearward end. A ⅛ inch hose coupling 38 threadedly attaches the secondary fluid supply hose to the hose nut. A primary fluid supply hose with a diameter of 1 inch is in operative association with the primary fluid inlet tube through the larger passage 54 in the hose nut 56 which is threaded at the rearward end. A 1 inch hose coupling 24 threadedly attaches the primary fluid supply hose to the hose nut.

The tailpiece functions to prevent dirt from entering the tool and to dampen the vibrations when the tool is in operation. The taper attachment portion of the tailpiece 42 press fits into the tailpiece 44. Together, these tailpiece portions cover the entire hose coupling region. A flanged portion of the outer fluid inlet tube 62 helps prevent the forward axial displacement of the tailpiece 44.

The tailpiece assembly 40 comprises a shock damper 48 made of elastomeric material for dampening the vibrations caused by the impacting motion within the tool. The shock damper 48 is fixedly attached to the exterior of the outer fluid inlet tube 58 and to the interior of a steel canister 47. The steel canister 47 is then press fit into the tailpiece 44. Axial exhaust passages 46 transverse the tailpiece 44. A flanged portion 45 on the tailpiece, in conjunction with the canister 47 and fixedly attached shock dampener 48, helps prevent the rearward axial displacement of the outer fluid inlet tube. The interior circular surface 49 of the tailpiece 44 facing towards the front of the tool serves as the forwardly facing impact surface when the tool is operated in the reverse mode.

The secondary fluid supply comprises a control valve 32 mounted in the line at a convenient position for control, preferably at the operator's station, for supplying pressurized fluid to or exhausting pressurized fluid from the directional valving member 100. The control valve contains ports 34 such that when the lever 33 on the control valve is positioned perpendicular to the secondary fluid supply hose 36 the pressurized fluid is exhausted from the directional valving member 100. When the lever 33 is positioned parallel to the secondary fluid supply hose 36, pressurized fluid passes into the directional valving member 100.

FORWARD OPERATION

To begin operation of the tool in the forward mode, the control valve is positioned to pressurize chamber 102. The pressurized fluid passes along the interior of the outer fluid inlet tube 58 and through the slots 68 in the supporting ferrule 66 into the valve member chamber 102. The pressurized fluid present in the valve member chamber 102 and the spring 104 within the directional valving member 100 maintain the precompression position as indicated in FIG. 1. The directional valving member 100 is prevented from sliding further forward by a retaining ring 64 circumferentially surrounding the inner fluid inlet tube 60. "O" ring seals 106 and 107 between the directional valving member 100 and the outer and inner fluid inlet tubes 58 and 60 permit the sliding motion of the directional valving member 100 over the tubes while preventing the leaking of pressurized fluid from within the valve member chamber 102.

The primary fluid supply is then initiated and pressurized fluid is fed by the primary fluid supply line 22 through the interior of the inner fluid inlet tube 60 into the rear operating chamber 72. The presence of pressurized fluid in the valve member chamber 102 and the force of the spring 104 prevents the pressure exerted by the pressurized fluid in the rear operating chamber 72 on the directional valving member 100 from moving the member 100 from the forward position. The force of pressurized fluid in the rear operating chamber 72 pushes the striker 70 forward to impact against the rearwardly facing impact surface 92 of the anvil 90, i.e., the front or forward impact surface. The ports 74 overlie the outer surface of member 100 to prevent air flow from chamber 72 to chamber 80. As the striker 70 approaches the forwardmost position in it axial pathway, ports 74 in the striker move past the forward end of member 100 and begin to connect the rear operating chamber 72 with the forward operating chamber 80. As pressurized fluid begins accumulating in the forward chamber 80, the striker 70 is forced in a rearward direction due to the increased surface area of the exterior of the striker 70.

Because of the position of the directional valving member 100, the front operating chamber 80 connects with the axial exhaust passages 46 as the striker moves rearward well before the striker would hit surface 49. The pressurized fluid in the front operating chamber is thereby exhausted to the atmosphere. When this occurs, the high pressure inside the rear operating chamber 72 causes the striker 70 to being to travel forward once more. This reciprocal movement will continue as long as the primary fluid supply 20 continues to supply pressurized fluid to the rear operating chamber 72.

REVERSE OPERATION

To begin operation in the reverse mode, the lever 33 on the control valve 32 is positioned perpendicular to the secondary fluid supply hose 36. This simultaneously terminates the supply of pressurized fluid to the valve member chamber 102 and enables the exhaust of pressurized fluid present in the valve member chamber 102 to the atmosphere through ports 34 in the control valve 32. As the fluid is exhausted from the valve member chamber 102, the pressure exerted on the directional valving member 100 by the pressurized fluid in the rear operating chamber 72 causes the directional valving member 100 to slide rearward, thereby compressing the spring 104, and moving valving member 100 to the rearward position shown in FIG. 3. When the spring 104 is compressed, the directional valving member 100 extends past the cupped flange 63 of the outer fluid inlet tube 58. The cupped flange 101 of the directional valving member 100 is slid back to the wrench flat 61 on the inner air inlet tube 60.

The primary fluid supply 20 continually supplies pressurized fluid to the rear chamber 72. With the directional valving member 100 now in the position depicted in FIG. 3, the forward path of the striker 70 is shortened, and the rearward path is lengthened. During forward movement of the striker 70, the ports 74 in the striker 70 connect the rear operating chamber 72 with the forward operating chamber 80 sooner than when the tool is operating in the forward mode. The striker 70 thus begins traveling rearward before impacting on the rearwardly facing front impact surface 92. During the rearward movement of the striker 70, the ports 74 in the striker 70 connect the forward chamber 80 with the atmosphere through the axial exhaust passages 46 much later (i.e., the striker must be closer to the tailpiece than when this occurs in the forward mode). As shown in FIG. 3, the ports 74 in the striker 70 don't connect the forward chamber 80 with the axial exhaust passages 46 until the rear impact surface 78 of the striker 70 virtually abuts against the forwardly facing rear impact surface 49 of the tailpiece 40. Impact against the rear of the tool is thereby achieved. As with the forward operation, the striker 70 will continue to reciprocate against the rearwardly facing impact surface 49 as long as the primary fluid supply 20 continues to supply pressurized fluid to the rear operating chamber 72.

To switch back to the forward mode, the lever 33 on the control valve 32 is once again positioned parallel to the secondary fluid supply hose 36. As pressurized fluid begins to pass into the valve member chamber 102, the pressure exerted within the valve member and spring 104 cause the directional valving member 100 to slide forward to the position shown in FIG. 1, abutting the retaining ring 64. The retaining ring 64 around the inner air inlet tube 60 prevents the directional valving member 100 from sliding any further along the inner fluid inlet tube 60. With the directional valve in the position shown in FIG. 1, the striker 70 once again impacts against the rearwardly facing front impact surface 92 of the anvil 90 during forward axial movement.

It will be understood that the above description is of a preferred exemplary embodiment of the invention and is meant to be illustrative, not limitative. Modifications may be made in the structural features of the invention without departing from the scope of the invention as expressed in the appended claims.

I claim:

1. A method for alternating the operation of a reversible impact operated boring tool between the forward mode and the reverse mode comprising the following steps:

(1) pressurizing the interior chamber of a control sleeve with high pressure fluid from a control fluid supply line, whereby the control sleeve is maintained in a first position to operate the tool in the forward mode;

(2) pressurizing the interior cavity of a striker with high pressure fluid from an operating fluid supply line;

(3) maintaining the supply of high pressure fluid to the interior of the striker for facilitating reciprocal motion of the striker to operate the tool in the forward mode; and (4) depressurizing the interior chamber of a control sleeve by exhausting the high pressure fluid from the interior chamber while maintaining the supply of high pressure fluid to the interior of the striker, whereby the force of the high pressure fluid within the interior cavity of the striker upon the control sleeve moves the control sleeve to a second position to operate the tool in the reverse mode.

2. A reversible impact operating boring tool operable in a forward mode and in a reverse mode from a source of high pressure operating fluid, comprising:

a housing assembly having a hollow interior, said housing assembly defining a forward striker surface and a rearward striker surface at opposite ends of the hollow interior;

a striker reciprocal within the hollow interior of the housing assembly between the forward and rearward striker surfaces, the striker having an interior cavity defining an inner surface and at least one port formed therethrough to connect the interior cavity to the hollow interior of the housing;

an operating fluid supply tube extending proximate the interior cavity of the striker to supply operating fluid to the interior cavity;

a control fluid supply tube concentric with said operating fluid supply tube defining an annular control fluid passage therebetween;

a control sleeve in sliding contact with the inner surface of the striker, said control sleeve further mounted in slidable sealed contact at a forward end thereof to the operating fluid supply tube and in slidable sealed contact at a rearward end thereof to the control fluid supply tube to define a control chamber connected to the control fluid passage, said control sleeve slidable between a first, forward position and a second rearward position;

the striker reciprocating between the forward striker surface and a position intermediate said striker surfaces with the control sleeve in the forward position, the striker reciprocating between the rearward striker surface and a point intermediate said striker surfaces with the control sleeve in the rearward position; and means to selectively provide a control fluid through the control fluid passage to the control chamber to maintain the control sleeve in the first position, the operating fluid pressure in the interior cavity acting on the control sleeve to move the control sleeve to the rearward position in the absence of control fluid pressure in the control chamber to selectively operate the impact operated boring tool in the forward or reverse modes.

3. A reversible impact operated boring tool operable in a forward mode and in a reverse mode from a source of high pressure operating fluid, comprising:

a housing having a hollow interior, said housing defining a forward striker surface;

a striker reciprocal within the hollow interior of the housing, the striker having an interior cavity defining an inner surface and at least one port formed therethrough to connect the interior cavity to the hollow interior of the housing, said striker tapering frustoconically to a flat impact surface at a forward end thereof and having a flat, annular impact surface at a rearward end thereof;

an operating fluid supply tube extending into the interior cavity of the striker to supply the operating fluid to the interior cavity necessary to the impact operation of the boring tool, said operating fluid supply tube having a supporting ferrule with a flange;

a hose nut having a forward surface having an annular notch, said operating fluid supply tube threadedly attached to said hose nut;

an operating fluid coupler, said hose nut threadedly attached thereto, said operating fluid coupler connected to said source of high pressure operating fluid;

a control fluid supply tube assembly having a control fluid supply tube concentric with said operating fluid supply tube and defining an annular control fluid passage therebetween, said control fluid supply tube extending to a flange having an annular groove at a forward end thereof, and said control fluid supply tube assembly having an O-ring received in said annular groove thereby forming a first O-ring/flange assembly, said control fluid supply tube being pressed against the forward surface of the hose nut, when the operating fluid supply tube is threadedly attached to said hose nut, by the flange on the supporting ferrule pressing against the forward end of the control fluid supply tube;

a control fluid coupler, said hose nut being threadedly attached thereto;

a tailpiece surrounding the fluid supply tubes, said tailpiece having a flat annular rearward striker surface at a forward end thereof, said tailpiece having axial exhaust passages connecting the hollow interior of the housing with the atmosphere, whereby air is exhausted to the atmosphere from the hollow interior of the housing allowing the striker to reciprocate within the housing;

a shock dampener supporting the fluid supply tubes in the tailpiece and providing a means for dampening the transfer of shock produced by the impact of the tool, said shock dampener circumferentially surrounding the control fluid supply tube and being press fit into the tailpiece;

a control sleeve assembly having a control sleeve in sliding contact with the inner surface of the striker, said control sleeve having an inwardly facing flange at a forward end thereof, said forward flange of the control sleeve having an annular groove, and said control sleeve assembly having an O-ring received in said annular groove thereby forming a second O-ring/flange assembly, said second O-ring/flange assembly sliding over the operating fluid tube at the forward end of said control sleeve whereby said control sleeve is in slidable sealed contact with the operating fluid supply tube, said control sleeve sliding over the first O-ring/flange assembly of the control fluid supply tube at a rearward end of said control sleeve whereby said control sleeve is in slidable sealed contact with the control fluid supply tube, said slidable sealed contacts of the control sleeve defining a control chamber connected to the control fluid passage, said control sleeve further having an interior spring circumferentially surrounding the operating fluid supply tube, said spring being slightly compressed upon assembly, said control sleeve slidable between a first, forward position and a second, rearward position;

the striker reciprocating within the housing between the forward striker surface and a position intermediate said rearward striker surface with the control sleeve in the forward position, the striker reciprocating between the rearward striker surface and a point intermediate said forward striker surface with the control sleeve in the rearward position; and means to selectively provide a control fluid through the control fluid passage to the control chamber to maintain the control sleeve in the first position, the operating fluid pressure in the interior cavity of the striker acting on the control sleeve to compress said spring and move the control sleeve to the rearward position in the absence of control fluid in the control chamber to selectively operate the impact operated boring tool in the forward or reverse modes.

* * * * *